US007164393B2

(12) United States Patent
Leslie

(10) Patent No.: US 7,164,393 B2
(45) Date of Patent: Jan. 16, 2007

(54) DISPLAY OF SYMMETRICAL PATTERNS WITH ENCODED INFORMATION

(76) Inventor: John Andrew Leslie, 64 Forbes Ave., Guelph, Ontario (CA) N1G 1G4

( * ) Notice: Subject to any disclaimer, the term of this patent is extended or adjusted under 35 U.S.C. 154(b) by 377 days.

(21) Appl. No.: 10/309,813

(22) Filed: Dec. 5, 2002

(65) Prior Publication Data

US 2003/0145497 A1 Aug. 7, 2003

(51) Int. Cl.
*G09G 3/00* (2006.01)

(52) U.S. Cl. ..... 345/31; 345/30; 345/32; 345/5

(58) Field of Classification Search ..... 345/30, 345/31, 32, 5; 40/66; 273/157 A
See application file for complete search history.

(56) References Cited

U.S. PATENT DOCUMENTS

| | | | | | |
|---|---|---|---|---|---|
| 1,796,903 | A | | 3/1931 | Wheeler | |
| 1,851,585 | A | | 3/1932 | Kliegl | |
| 2,786,292 | A | | 3/1957 | Graves | |
| 3,099,933 | A | | 8/1963 | Weiner | |
| 3,122,859 | A | | 3/1964 | Reaux | |
| 3,160,975 | A | * | 12/1964 | Malina | 40/436 |
| 3,711,697 | A | | 1/1973 | Boyle | |
| 3,782,836 | A | * | 1/1974 | Fey et al. | 356/446 |
| 4,052,074 | A | | 10/1977 | Fogle | |
| 4,085,932 | A | | 4/1978 | Hamano | |
| 4,231,634 | A | | 11/1980 | Gantz | |
| 4,527,186 | A | | 7/1985 | Acker | |
| 4,631,848 | A | | 12/1986 | Iwasa | |
| 5,110,206 | A | | 5/1992 | Mischke | |
| 5,225,934 | A | | 7/1993 | Kroll | |
| 5,264,881 | A | | 11/1993 | Brooke | |
| 5,520,388 | A | * | 5/1996 | Osborn | 273/157 |
| 5,769,418 | A | * | 6/1998 | Gilbert et al. | 273/157 A |
| 6,009,647 | A | | 1/2000 | Feingold | |
| 6,138,393 | A | | 10/2000 | Idesawa | |
| 6,300,983 | B1 | * | 10/2001 | Fels et al. | 348/580 |
| 6,555,760 | B1 | * | 4/2003 | Foster, Sr. | 174/261 |

* cited by examiner

*Primary Examiner*—Richard Hjerpe
*Assistant Examiner*—Leonid Shapiro
(74) *Attorney, Agent, or Firm*—Jeffrey W. Wong; Borden Ladner Gervais LLP

(57) ABSTRACT

A first pattern is created by providing an image and its enantiomorph on opposite sides of an axis of bilateral symmetry and selectively removing elements from the image and its enantiomorph without removing any element from both the image and its enantiomorph. A second pattern is created, being an enantiomorph of the first pattern. The patterns are rotated relative to each other about a common axis with both patterns visible to a viewer, whereby an intelligible pattern having at least one axis of bilateral symmetry is formed by a combination of the patterns at at least one position of the first pattern relative to the second pattern. At other positions the intelligible pattern is present only in an encoded fashion. The encoding is done by ensuring that elements are missing from the first pattern so that it is unable in itself to constitute an intelligible design, the missing elements being supplied when the first pattern is appropriately combined with the second pattern.

2 Claims, 10 Drawing Sheets

DISPLAY OF SYMMETRICAL PATTERNS WITH ENCODED INFORMATION

BACKGROUND OF THE INVENTION

1. Field of the Invention

The present invention generally relates to generation of visual effects by combining a first pattern with a second pattern, and more particularly to combining patterns where the second pattern is an enantiomorph (or "mirror image") of the first pattern, with the combined first and second patterns producing an intelligible image only when in specific positions relative to each other.

2. Description of the Prior Art

Traditionally, several toys, advertising devices and other devices create variable patterns that can be beautiful and eye-catching because they have bilateral symmetry (as does a butterfly) or rotational symmetry (in which the same pattern appears more than once around a circle) or symmetry of both kinds together. The kaleidoscope invented by David Brewster is an example: fragments of colored glass, for instance, are reflected by mirrors so that they generate visible patterns, which vary although they always remain symmetrical (both bilaterally and rotationally). Other devices provide visible elements that can be brought together to form intelligible designs, for example when concentric discs become properly aligned. There are various patents in the same general area as the invention.

U.S. Pat. No. 3,122,859 (La Reaux) discloses a viewing-tube toy, in which a range of elements can be added to an intelligible design. For instance, a man can be given a choice of hats, or can appear with or without a beard. The various elements are arranged on concentric sheets, which can be rotated independently, the varying visible combinations then filling a sector of a circle that is viewed through the tube.

U.S. Pat. No. 3,099,933 (Weiner) discloses a viewing-tube toy, in which a pattern is rotated, only half the pattern being visible at any stage. The visible half is reflected in a mirror, so that a bilaterally symmetrical arrangement is seen in the tube. Several successive intelligible shapes can be encoded into the pattern. If, for instance, the left half of a butterfly is shown in part of the pattern, then at one stage in the rotational cycle the entire butterfly will be seen.

U.S. Pat. No. 6,009,647 (Feingold) discloses the scrambling and unscrambling of a message which is distributed between at least three concentrically arranged discs. The discs are independently rotatable, the message appearing when they are properly aligned.

U.S. Pat. No. 6,300,983 (Fels et al.) discloses patterns coming from a television camera and subsequently processed electronically so that the patterns are seen distributed around a circle, half the time rotated and half the time mirror-imaged as well as rotated, so that rotational and bilateral symmetry is generated. A televised man, for instance, could be seen as facing himself in several sectors of the circle.

U.S. Pat. No. 1,796,903 (Wheeler et al.) discloses concentric drums, an intelligible design being rotated inside a copy of the design that is exact rather than mirror-imaged. The design will therefore be seen when the drums become properly aligned.

Devices such as these reflect a widespread interest in variable patterns, symmetrical patterns and encoded patterns that can become decoded. However, prior inventors have produced comparatively uninteresting and unattractive visual effects because they have failed to take advantage of the fact that when a first pattern is appropriately combined with a second which is its enantiomorph and which is rotatable relative to it, bilateral and optionally also rotational symmetry will be present in all stages in the rotational cycle, and one can encode an intelligible design of absolutely any desired complexity into the first pattern so that it appears unexpectedly at one or more stages in the cycle.

SUMMARY OF THE INVENTION

It is an object of the invention to generate visual effects by combining a first and a second pattern, the second pattern being the enantiomorph ("mirror image") of the first pattern, so that a particular message or image is visible only when the patterns are appropriately positioned relative to each other, thereby unexpectedly displaying the message or image to a viewer.

In the invention, first and second patterns are created, one pattern being the enantiomorph of the other, and means are provided for rotating one or both patterns to vary their relative alignment. The second pattern is visually combined with the first pattern, so that an intelligible pattern, having at least one axis of bilateral symmetry, is formed by the combination of the patterns at at least one position of the first pattern relative to the second pattern.

In one embodiment of the invention, the patterns are formed on a light transmissive material, and the patterns are located between a light source and the viewer. Alternatively, the light source may for example be located so that light reaches the second pattern and at least in part passes through the second pattern to a surface carrying the first pattern, the light reaching the viewer by being reflected by the second pattern or by the surface carrying the first pattern.

In an alternative embodiment, the patterns are generated by electronic means and combined in varying relative positions by the electronic means. The electronic means is advantageously a computer and the combination of the patterns is displayed on a computer monitor or similar device.

The method of the invention includes the steps of creating a first pattern, the pattern encoding intelligible information in such a way that it would be decoded if combined with a suitably aligned enantiomorph of the pattern; providing a second pattern, which is the enantiomorph of the first pattern; and providing means for rotating the first pattern relative to the second pattern, so that an intelligible pattern, having at least one axis of bilateral symmetry, is formed by a combination of the patterns at at least one position of the first pattern relative to the second pattern.

Other features of the invention will become apparent to those ordinarily skilled in the art upon review of the following description of specific embodiments of the invention in conjunction with the accompanying drawings.

BRIEF DESCRIPTION OF THE DRAWINGS

The invention will now be described in greater detail, with reference to the accompanying drawings of preferred embodiments of the invention, by way of example only. In the drawings.

DETAILED DESCRIPTION

Figure 1:
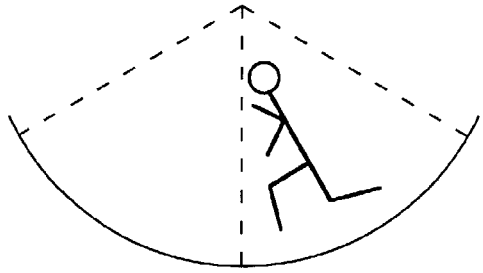
FIG. 1 is an illustration of the first step in forming the first pattern, showing an intelligible design.

In the invention, bilaterally symmetrical visual effects are generated by combining a first pattern 1 with a second pattern 2. The second pattern is the mirror image or "enantiomorph" of the first pattern. When the first pattern is appropriately positioned relative to the second pattern, and is rotated about an appropriately chosen axis of rotation 3 in a direction of rotation R (see FIG. 6), bilateral or bilateral-and-rotational symmetry will be present throughout the rotational cycle. An encoded intelligible design of any desired complexity can be present in the first and second patterns, so that the intelligible design appears unexpectedly at one or more stages in the rotational cycle.

The invention provides encoding of any intelligible design by providing the first pattern 1 that, when visually combined with the second pattern 2, being the enantiomorph of the first pattern and being rotatable relative to the first pattern, forms combinations that possess bilateral symmetry and optionally also rotational symmetry at all stages in the rotational cycle, the desired decoded design being generated only at some stage or stages in the rotational cycle. The encoding is provided by ensuring that components missing from the first pattern, so that it is unable in itself to constitute the desired intelligible design, will be supplied when the first pattern is suitably combined with its enantiomorph second pattern (see FIGS. 1 to 4). This is because the first pattern contains, in its one half, mirror images of all the elements missing from its other half.

One simple example of how to achieve the above is by using a first light transparent sheet (transmissive to visible light) having an image formed onto it, the image being transparent, at least partly transparent or non-transparent. When the first sheet is placed on a light reflective surface, for example a white surface, or a light transmitting surface, for example a glass surface having a light source behind it, the image formed on the first sheet is visible to a viewer. If a second light transparent sheet identical to the first sheet is laid upon the first sheet back-to-front, i.e. mirrored relative to the first sheet, the desired display of information will occur only when the first sheet and the second sheet are aligned in such a way that the design is formed from the various elements present either on the first sheet or the second sheet (see FIGS. 5A–11).

When, for example, through one or both of two sheets being moved by hand or mechanically or by other means, the first pattern is rotated relative to the second pattern around any point on an axis of bilateral symmetry that is formed when the first pattern is combined with the second pattern, the symmetry is preserved at all stages in the rotational cycle. For example, bilateral symmetry is preserved when the first and second patterns are formed on transparent circular sheets maintained concentrically, by an enclosing rim or a central pivot or manual adjustment or other means, on a flat white surface. Symmetry is similarly preserved when the patterns are formed on a curved surface when the sheets are flexible and are bent, for instance by an enclosing rim, so as to conform to the surface throughout the rotational cycle. Bilateral symmetry can also be preserved on concave or convex surfaces of other circular shapes such as broad circular borders, hemispheres, spheres, cones, truncated cones or cylinders, because, for example, a bilaterally symmetrical pattern on a broad circular border could be distorted without loss of symmetry so as to cover the surface of a truncated cone or a cylinder.

The combination of the first pattern with its enantiomorph can be achieved through reflection, transmission or projection of natural or artificial light, or by any mixture of reflection, transmission and projection. For example, a circular pattern can be projected onto a surface (for instance flat, conical or hemispherical) which bears a printed enantiomorph of that same pattern. A further example is a truncated cone, for instance a paper cup or lampshade, bearing a printed pattern, which is placed inside a transparent sleeve carrying the pattern's enantiomorph. The resulting combined pattern is viewable both by daylight and by transmitted light in the case of the lampshade. The combination of the two patterns and the rotation of the one relative to the other can also be generated by other means, for instance electronic. Masking can be used so that only parts of the combined pattern are seen, for instance as filling the wings of a butterfly shape.

At one stage at least of the rotational cycle, the combined pattern or part of it forms an intelligible design. Colors used in the first and second patterns will combine to form "new" colors during the rotation, and will form the intended colors of the intelligible design when the alignment of the first and second patterns is appropriate. For example, a symmetrical face or a word composed of symmetrical letters could straddle the combined pattern's axis of bilateral symmetry (or one such axis if there is more than one). A further example is a cat which could appear to the left and its mirror image to the right. Alternatively, a written message could appear to the left. To the right, the message would be mirror-imaged and therefore unintelligible unless its letters had bilateral symmetry of an appropriate type, for example when the word BID was oriented in such a way that its mirror image was also the word BID. There will be two or more stages in the rotational cycle at which the intelligible design is formed if the first pattern (and hence also its enantiomorph) has rotational symmetry around the center of rotation. This is usually desirable since there is then, throughout the cycle, bilateral symmetry not only in the entire combined pattern, which has two or more axes of such symmetry, but also inside each of its rotationally symmetrical sectors, which can be beautiful and intriguing.

At most stages in the rotational cycle the intelligible design is present only in an encoded way: various elements of the design are absent from the first pattern but will be supplied by its enantiomorph once during the cycle, or n times when there is n-fold rotational symmetry (e.g., thrice when the symmetry is three-fold). The word ROSE, for instance, could be formed when elements became suitably combined at some stage, whereas at other stages these elements were separated. Preferably, none of the word's letters would be present (unless camouflaged by being divided into parts shaded or colored differently) at those other stages. This would be the case if the complete word had originally been written both in the one half and also, mirror-imaged, in the other half of an initial sketch of a pattern which was to be combined with its enantiomorph, encoding then being carried out by erasing various elements from the one half and from the other so that no entire letters of the word remained, even mirror-imaged, in either half, but each element needed to form any such letter, such as a curved line in the R, did remain either in the one half or else, mirror-imaged, in the other, to allow the word to be generated by combination of enantiomorphs. Not just lines and shapes, but colors as well, can be encoded by being split into elements that are combined when the intelligible design is formed. For instance, red and blue areas can combine to make a purple area. "Encoding" can thus be understood as follows. An intelligible design, or any component of it such as a line, a shape or a color, is encoded when it is not present in the abovementioned "first pattern" but will appear when, during the rotational cycle, that pattern becomes suitably combined with its enantiomorph.

Different intelligible designs can be arranged to become visible at different stages in the rotational cycle. For instance, two flat circular patterns can be combined to generate an intelligible design at one stage. Each of the patterns can be given a broad circular border, the two borders combining to generate another intelligible design at another stage.

Figure 2:
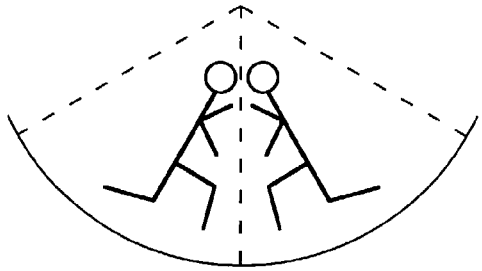
FIG. 2 is an illustration of the second step in forming the pattern, showing the added enantiomorph of the FIG. 1 design.
Figure 3:
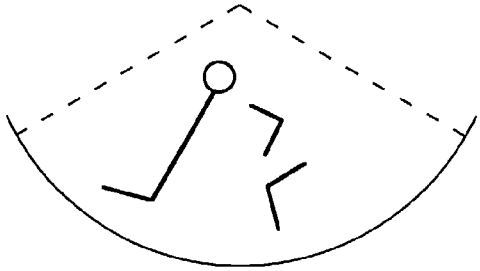
FIG. 3 is an illustration of the third step, showing selected elements erased from the FIG. 2 design.
Figure 4:
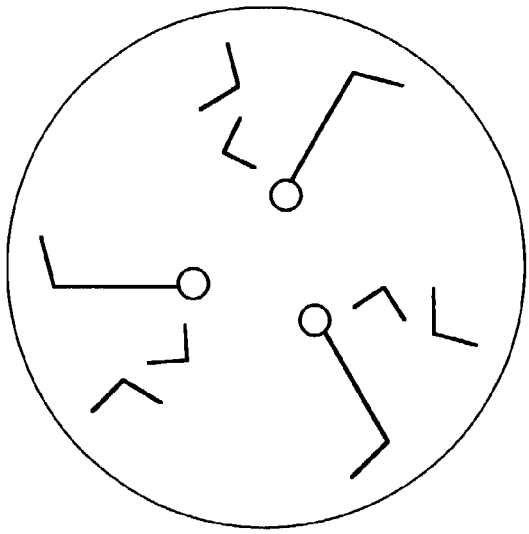
FIG. 4 is an illustration of the fourth step, showing the design of FIG. 3 copied into further sectors of a circle, the result constituting the first pattern.

FIGS. 1 to 4 show a step-by-step process to produce the first pattern and the second pattern for a simple design, having rotational symmetry. In FIG. 1, a one-sixth sector of a circle has been provided with an intelligible design. The enantiomorph pattern is provided in an adjacent sector, as shown in FIG. 2. Thereafter, elements are erased from either the first drawn pattern or its enantiomorph, as shown in FIG. 3, care being taken not to erase both an element and the enantiomorph of that element. The thus achieved version of an encoded pattern is copied onto the remaining segments of the circle, as shown in FIG. 4, to provide a first pattern, advantageously formed on a transparent material. An identical pattern is provided on another piece of transparent material, becoming the second pattern when it is flipped back-to-front. The second pattern is then placed so that it fully covers the first pattern, and the two patterns are rotated relative to each other about the center of the circle, being the axis of rotational symmetry of the two patterns.

Figure 5A:
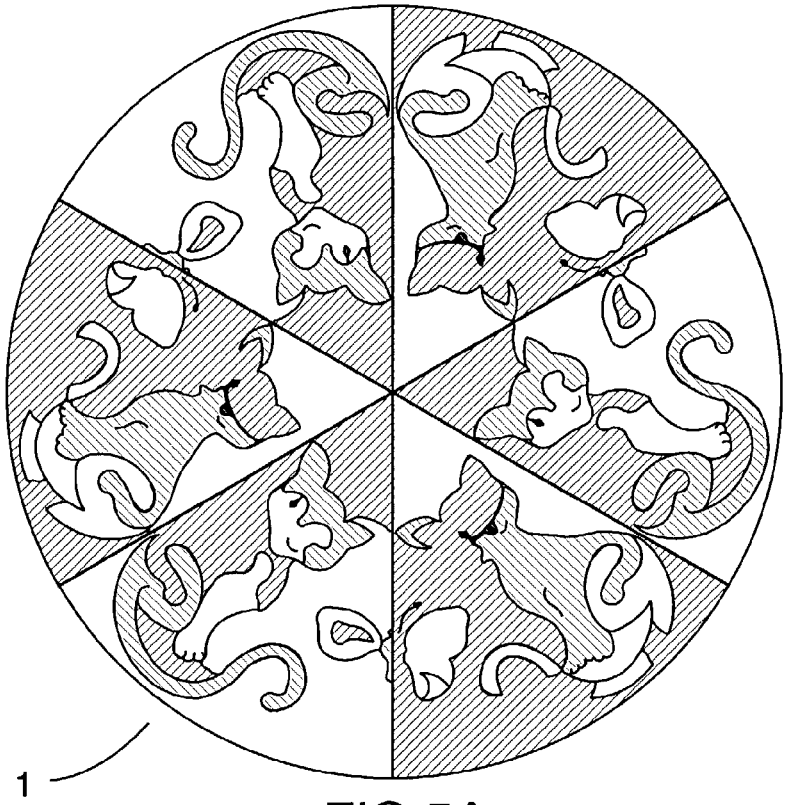
FIG. 5A is a plan view of another example of a first pattern, the hatching in this drawing and subsequent similar drawings indicating color only, not actual image detail.
Figure 5B:
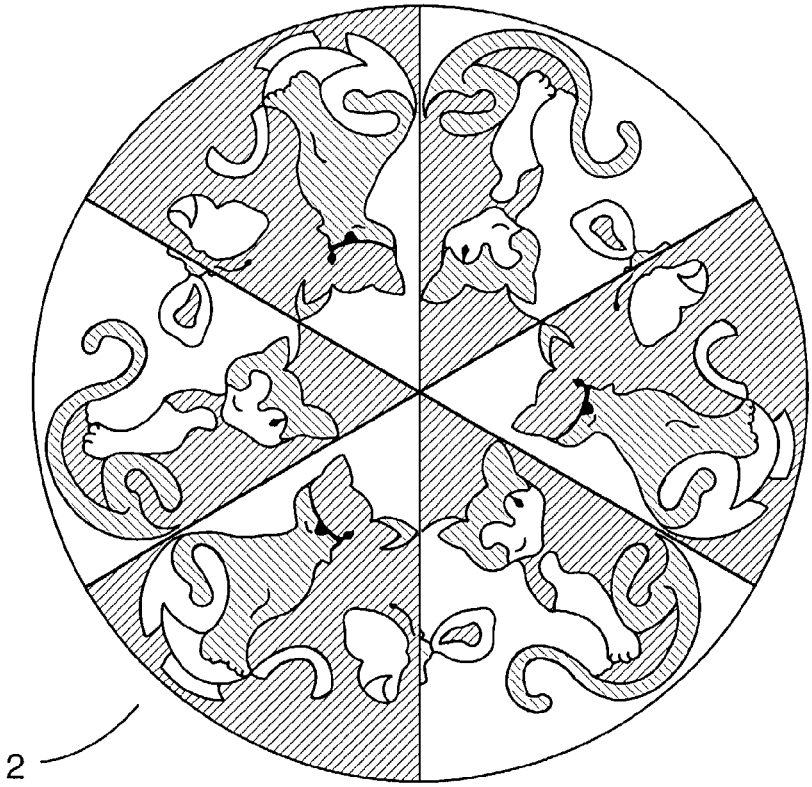
FIG. 5B is a plan view of the enantiomorph of FIG. 5A.
Figure 6:
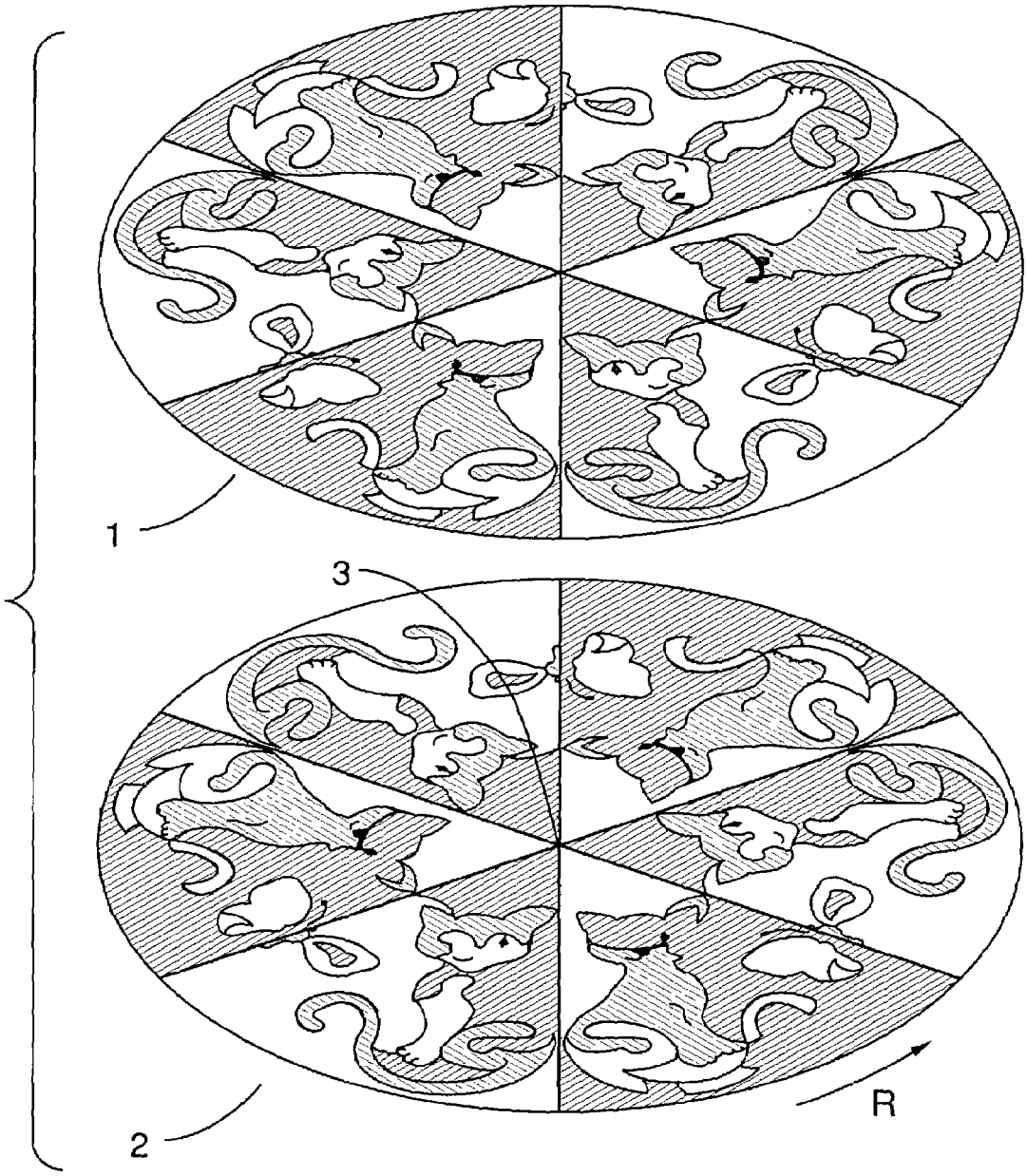
FIG. 6 is an exploded perspective view of the FIG. 5A and 5B patterns, aligned as necessary to produce the intelligible design.
Figure 7:
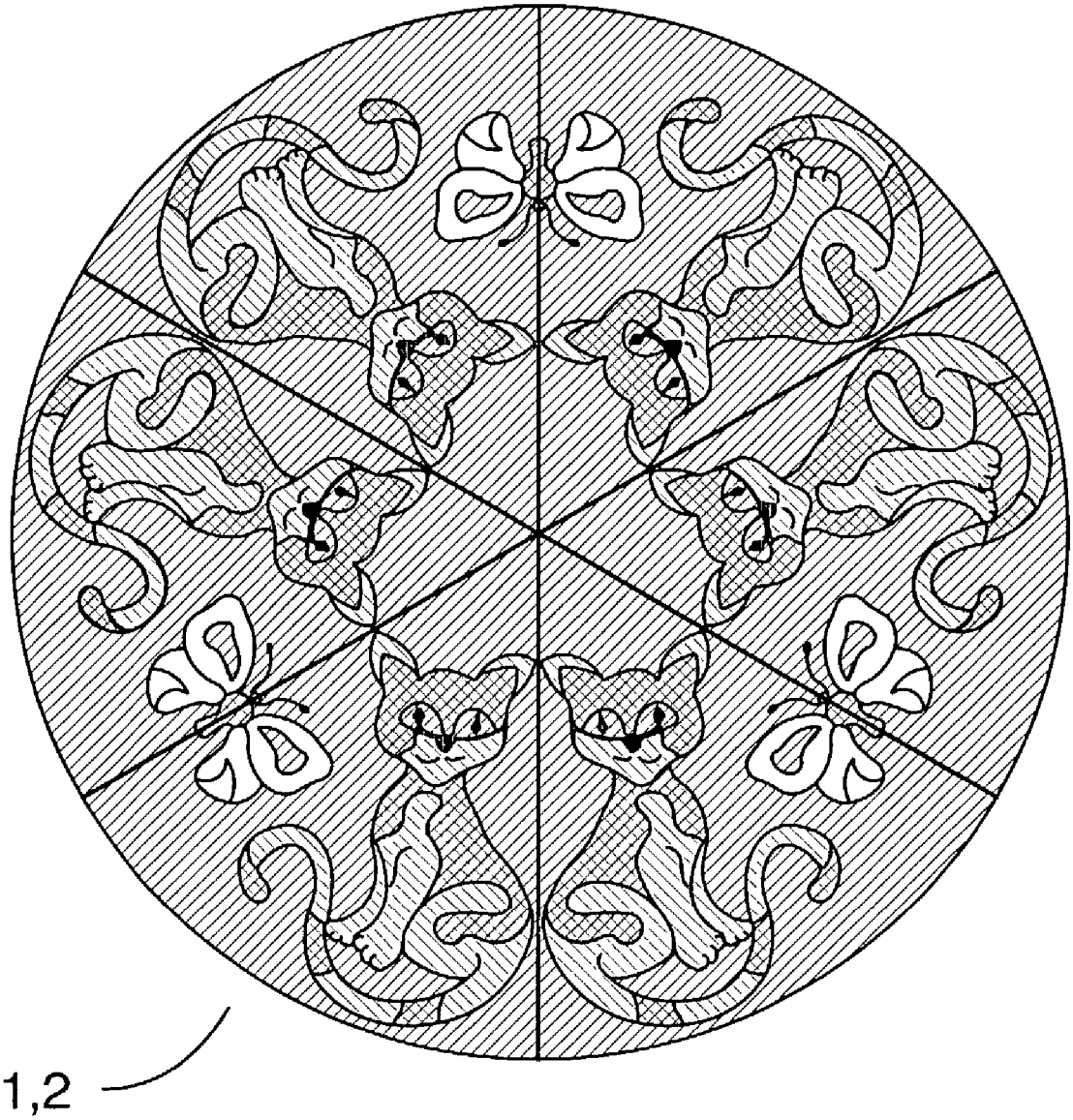
FIG. 7 is an illustration of the resulting design.

FIGS. 5A to 7 show a more detailed example of first and second patterns, and the design formed when they are appropriately aligned. FIG. 5A shows the first pattern, and FIG. 5B shows the second pattern. FIG. 6 is an exploded perspective showing the patterns, aligned as necessary to produce the intelligible design shown in FIG. 7. It should be noted that in FIGS. 5A to 11, the hatching is intended to indicate color only, not actual image detail. The hatching thus remains oriented to the page orientation, rather than rotating as the patterns rotate. This may cause some unavoidable confusion in looking at the hatching in FIG. 9, for example, requiring the reader to remember that the line direction on the page indicates the color; they are not "real" lines.

Figure 8:
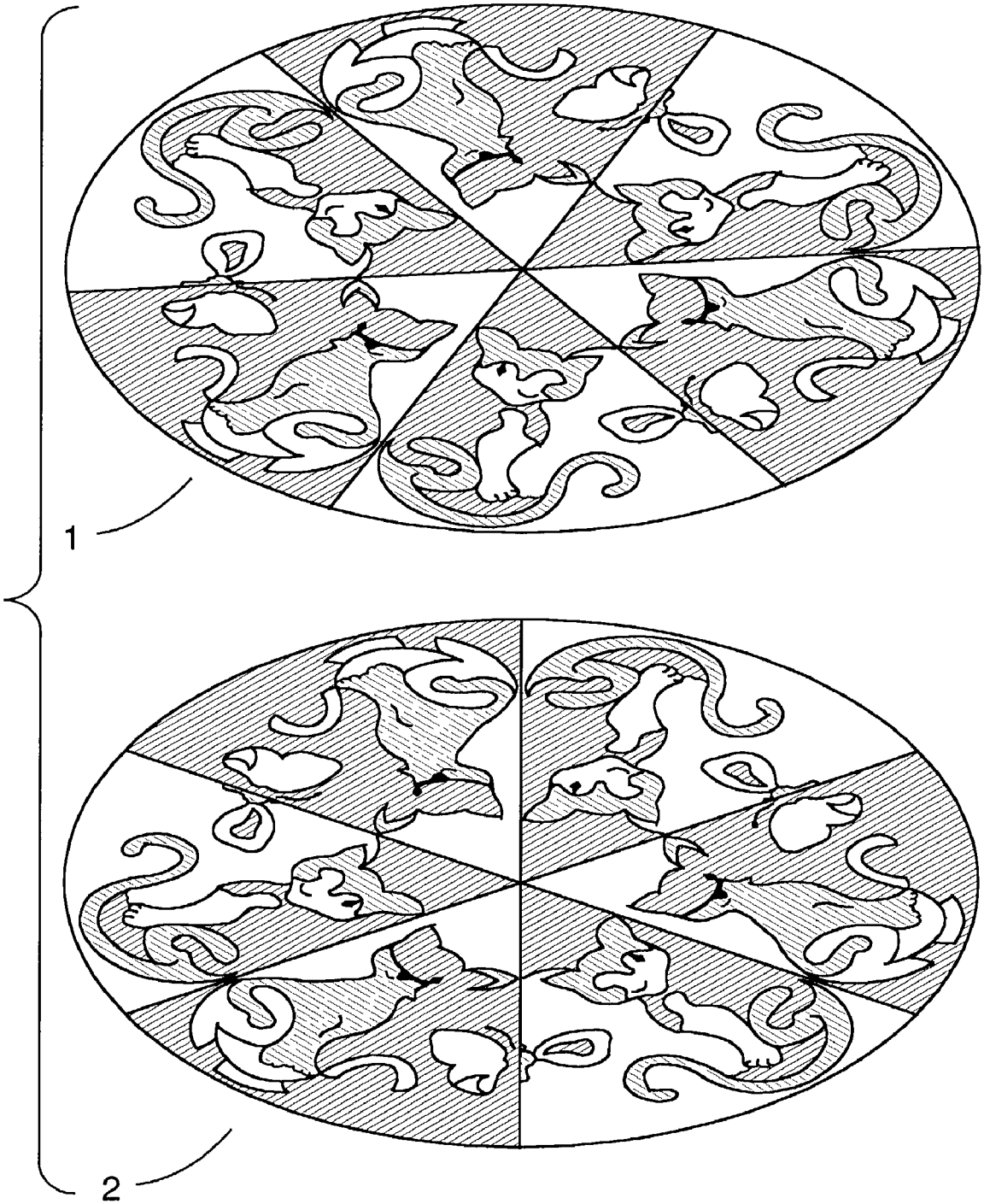
FIG. 8 is an exploded perspective view of the same patterns, slightly misaligned.
Figure 9:
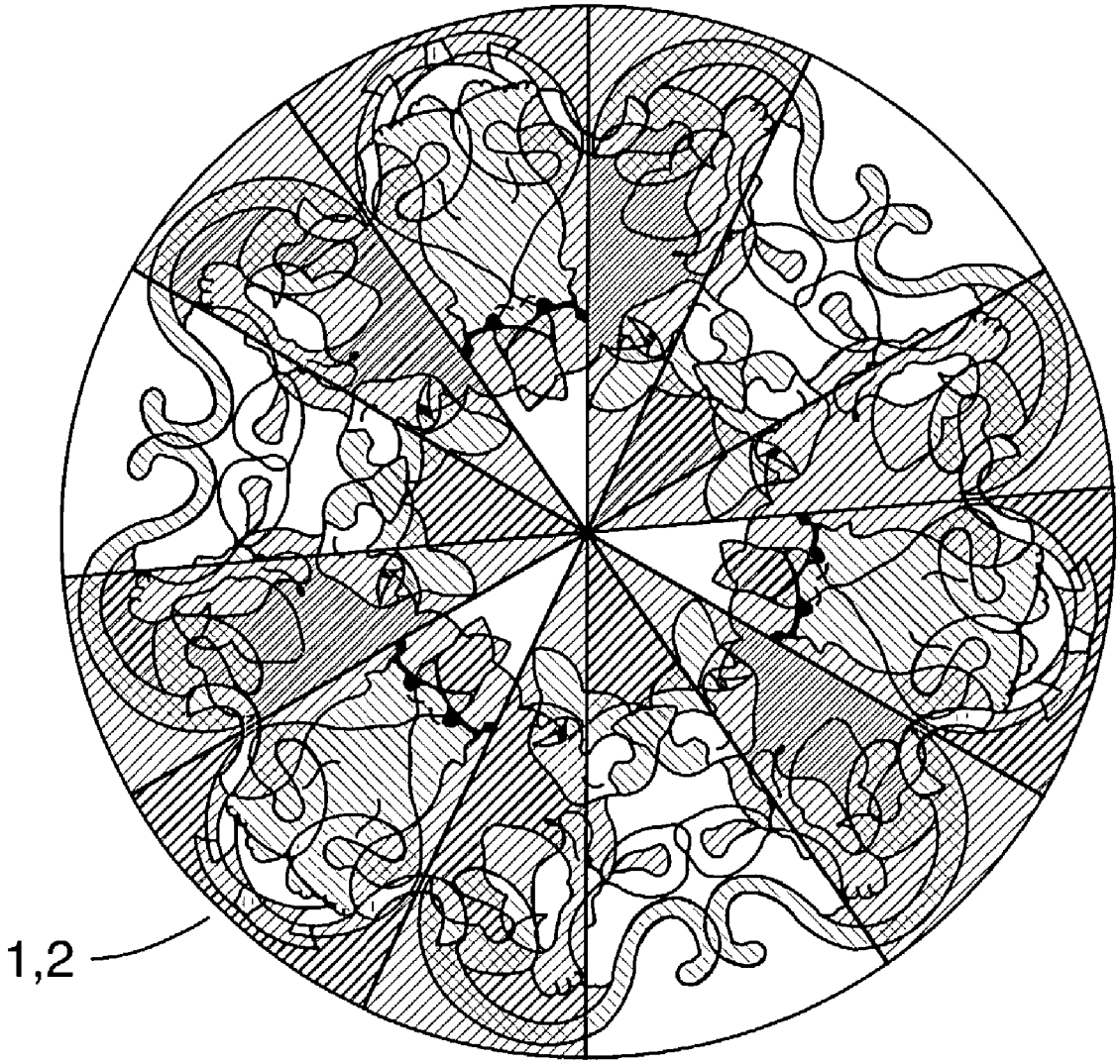
FIG. 9 is the unintelligible image resulting from FIG. 8.

FIGS. 8 and 9 show encoded displays of information, i.e. where the two patterns (the first and second, respectively) are rotated to positions where the desired design is not displayed, because the patterns do not align appropriately. The misalignment shown in FIG. 8 produces the unintelligible image shown in FIG. 9.

Figure 10:
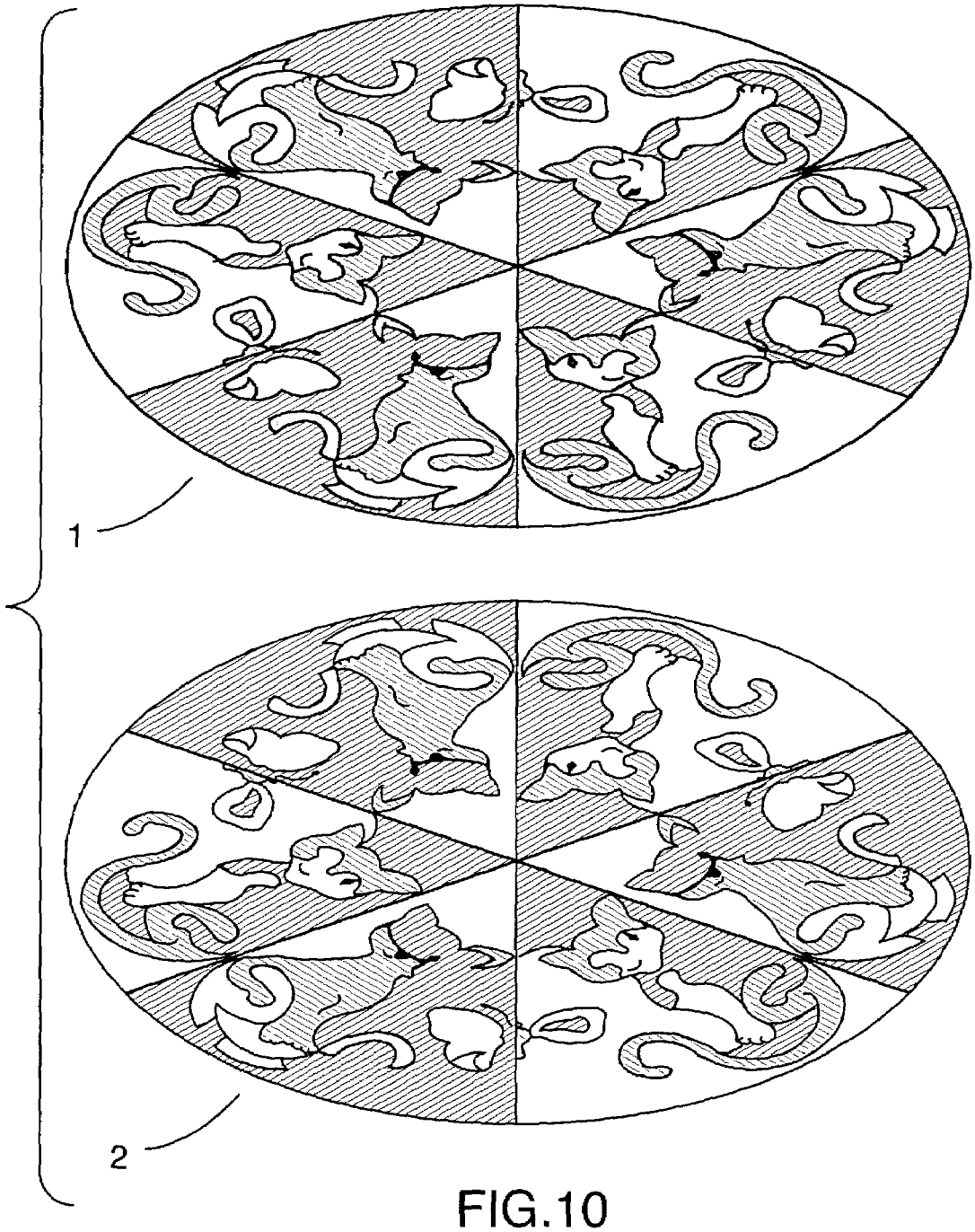
FIG. 10 is another exploded perspective view of the same designs, further rotated.
Figure 11:
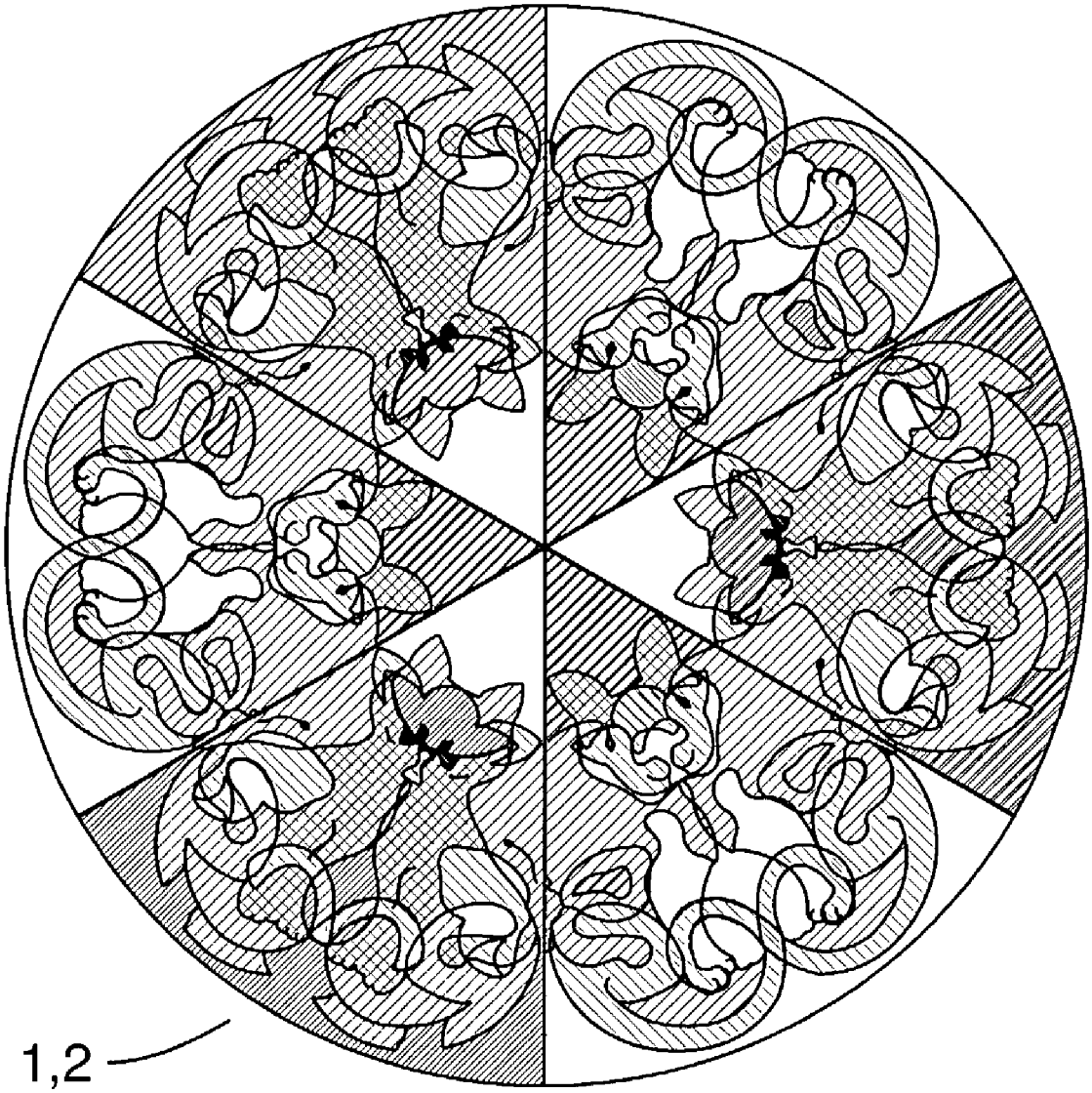
FIG. 11 is the unintelligible image resulting from FIG. 10.

FIGS. 10 and 11 shown the same encoded display where the patterns have been further rotated relative to each other. The misalignment shown in FIG. 10 produces the unintelligible image shown in FIG. 11.

Figure 12:
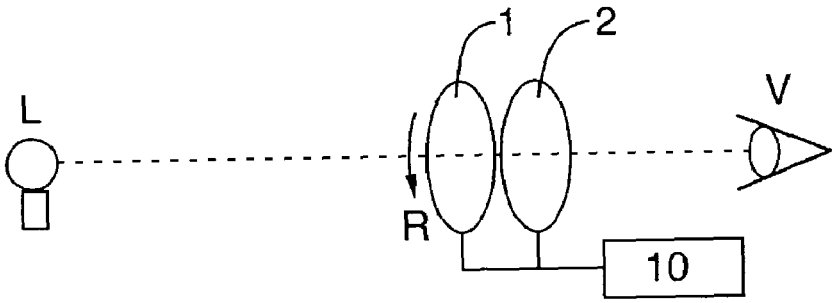
FIG. 12 is a schematic illustration of one embodiment of the invention, showing a light source shining through both patterns to the viewer.
Figure 13:
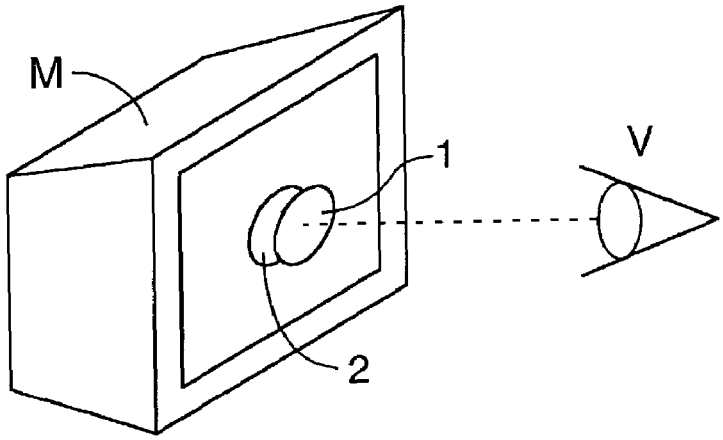
FIG. 13 is a schematic illustration of an alternative embodiment, showing pattern generation using a video display.
Figure 14:
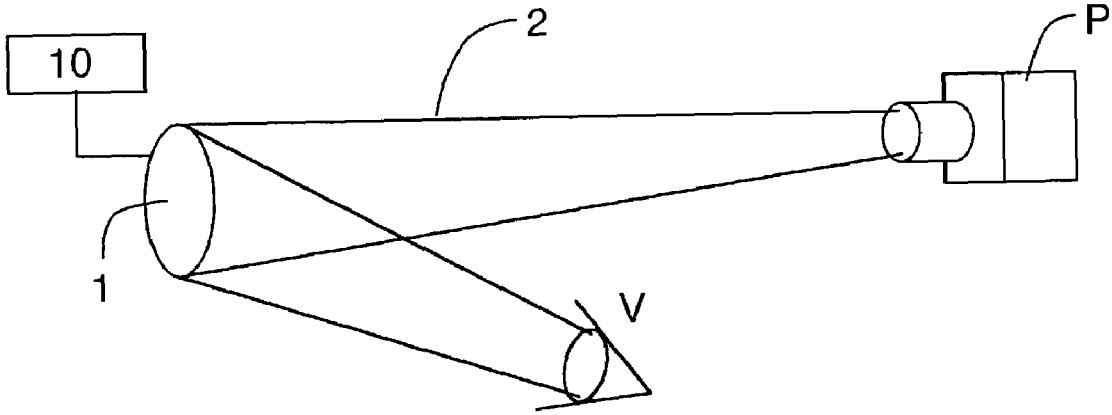
FIG. 14 is a schematic illustration of another alternative embodiment, showing a light source projecting one pattern onto the other pattern, the combined pattern being reflected towards the viewer.

FIGS. 12 to 15 show different arrangements for the generation of the intelligible pattern and how it is shown to a viewer V. In FIG. 12, a light source L shines through both the first pattern 1 and the second pattern 2 and on to the viewer. A rotation means 10 rotates one or both of the patterns in the direction R. In FIG. 13, both patterns are displayed using a video monitor M, or similar device. The patterns are generated and are rotated relative to each other by, for instance, a software program running on a computer (not shown). FIG. 14 shows the second pattern 2 being projected by a projector P onto the first pattern 1, one or both of the patterns being rotatable using the rotation means 10. The combined pattern is reflected to the viewer V.

Figure 15:
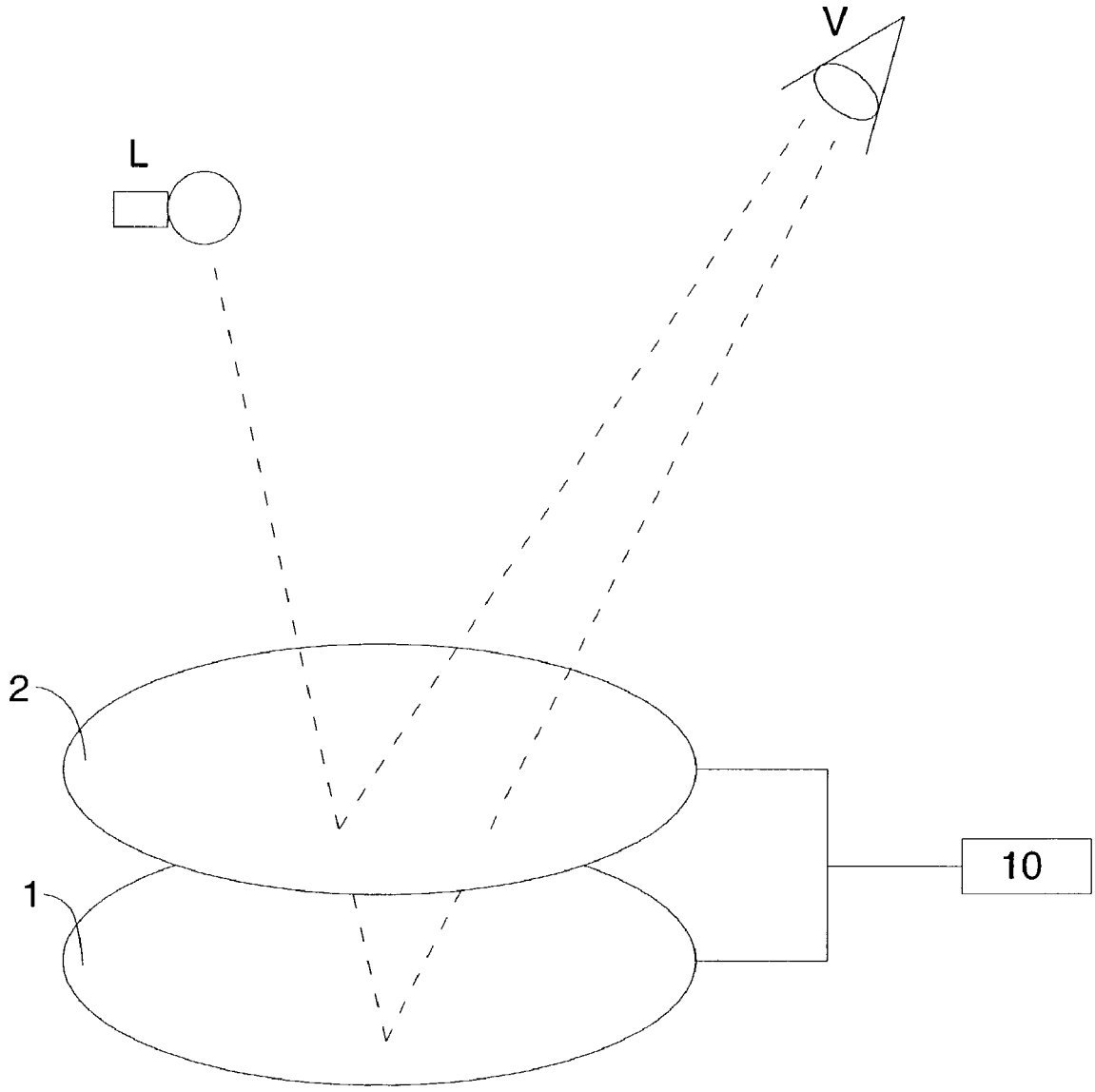
FIG. 15 is a schematic illustration of yet another alternative embodiment, showing a light source illuminating a second pattern which lies above a first pattern, the light at least in part passing through the second pattern and reaching the viewer after being reflected by the surface carrying the second pattern and the surface carrying the first pattern.

FIG. 15 shows another embodiment, showing a light source L illuminating a second pattern 2 which lies above a first pattern 1, the light at least in part passing through the second pattern and reaching the viewer after being reflected by the surface carrying the second pattern and the surface carrying the first pattern, one or both patterns being rotatable by the rotation means 10.

Examples of applications for the invention are advertising signs, point of sale displays, promotional gifts; packaging (lids, caps, conical tubs, cylindrical containers); window or wall or ceiling decorations (particularly at Christmas); tabletops, mats, trays, ashtrays; plates, bowls, cups, vases, jars; lampshades, lamps and children's night-lights having rotating layers; rotating central areas or broad borders of watches or clocks; picture and photograph frames, mirror frames; magnetically or adhesively attachable decorations; decorative covers of writing pads or of children's books; calendars, greetings cards, postcards and souvenirs (the intelligible designs might even be photographs of scenery); gift boxes; gift stickers and tags; badges, brooches, pendants for necklaces or bracelets, attachments to key rings; decorative interiors or exteriors of domes; tuning dials; balls (concentric spheres joined by spindles); toys of many kinds and for all ages; paperweights; coloring kits and other instances of the invention in kit form; or situations in which not just a single pair of patterns in which one is the enantiomorph of the other, but two or more such pairs, are combined with the help of manual adjustment or gearing or other means of maintaining the symmetry of the resulting visual effects.

It will be appreciated that the above description relates to the preferred embodiments by way of example only. Many variations on the invention will be obvious to those knowledgeable in the field, and such obvious variations are within the scope of the invention as described and claimed whether or not expressly described.

What is claimed is:

1. A method of displaying images in either intelligible or encoded fashion depending on the relative position of two patterns, said method comprising the steps of:

(a) creating a first said pattern, by providing an image and its enantlomorph on opposite sides of an axis of bilateral symmetry and selectively removing different elements from the image and its enantiomorph without removing the same element from both the image and its enantiomorph;

(b) creating a second said pattern, being an enantiomorph of the first said pattern;

(c) arranging said patterns for rotation relative to each other about a common axis with both said patterns visible to a viewer, whereby an intelligible pattern having at least one axis of bilateral symmetry is formed by a combination of said patterns at at least one position of said first pattern relative to said second pattern, where said first and second patterns are created by electronic means and rotated relative to each other by said electronic means.

2. A method as in claim 1, where said electronic means is a computer and said combination of said first and second patterns is displayed on a computer screen.

* * * * *

UNITED STATES PATENT AND TRADEMARK OFFICE

CERTIFICATE OF CORRECTION

PATENT NO. : 7,164,393 B2
APPLICATION NO. : 10/309813
DATED : January 16, 2007
INVENTOR(S) : John Andrew Leslie It is certified that error appears in the above-identified patent and that said Letters Patent is hereby corrected as shown below:

On Title Page, Insert -- Related US Application Data --; and

On Title Page, Item (60) Insert, -- (60) United States Patent Application Serial Number 60/342,117, filed December 26, 2001 --

Signed and Sealed this

Tenth Day of April, 2007

JON W. DUDAS
*Director of the United States Patent and Trademark Office*

UNITED STATES PATENT AND TRADEMARK OFFICE

CERTIFICATE OF CORRECTION

PATENT NO. : 7,164,393 B2
APPLICATION NO. : 10/309813
DATED : January 16, 2007
INVENTOR(S) : John Andrew Leslie It is certified that error appears in the above-identified patent and that said Letters Patent is hereby corrected as shown below:

Title Page, item (76), delete "64 Forbes Ave., Guelph, Ontario (CA) N1G 1G4" and insert therefor --Guelph, Ontario (CA)--.

Signed and Sealed this

Twentieth Day of May, 2008

JON W. DUDAS
*Director of the United States Patent and Trademark Office*